United States Patent [19]

Georg

[11] 4,026,407

[45] May 31, 1977

[54] CONVEYORS FOR MINERAL MINING INSTALLATIONS

[75] Inventor: Werner Georg, Lunen, Germany

[73] Assignee: Gewerkschaft Eisenhutte Westfalia, Westphalia, Germany

[22] Filed: Mar. 1, 1976

[21] Appl. No.: 662,607

[30] Foreign Application Priority Data

Mar. 6, 1975 Germany ..... 2509802

[52] U.S. Cl. ..... 198/735; 198/861; 299/34; 299/43

[51] Int. Cl.² ..... E21C 35/20

[58] Field of Search ..... 299/12, 32, 34, 43; 61/45 D; 198/204, 735, 861

[56] References Cited

UNITED STATES PATENTS

| | | | |
|---|---|---|---|
| 3,284,138 | 11/1966 | Binaut | 299/34 |
| 3,439,508 | 4/1969 | Payne et al. | 299/12 X |
| 3,640,580 | 2/1972 | White | 299/12 X |
| 3,784,256 | 1/1974 | Katlic | 299/43 X |

FOREIGN PATENTS OR APPLICATIONS

| | | | |
|---|---|---|---|
| 1,420,634 | 11/1965 | France | 61/45 D |

*Primary Examiner*—Ernest R. Purser

*Attorney, Agent, or Firm*—Thompson, Birch, Gauthier & Samuels

[57] ABSTRACT

A scraper-chain conveyor for transporting material at a mine face working has a series of pans and a screen used to screen-off the working zone carried by the sides of the pans remote from the face. The screen is composed of sections with two sections being allocated to each pan. Each screen section is composed of a lower wall secured through U-shaped springs to pivot pins permitting the whole section to be swung outwards of the face to a collapsed position. The pins extend through the bights of the springs and an upper wall is received for slidable movement between the arms of the springs. The upper walls can thus be raised into contact with the roof when the screen sections are upright. To hold the sections upright wedge-like locking members are inserted into brackets supporting the pivot pins to engage on the springs.

14 Claims, 5 Drawing Figures

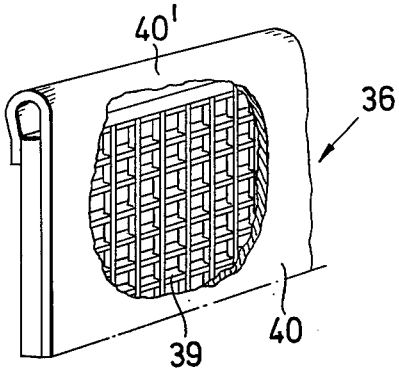
FIG. 4
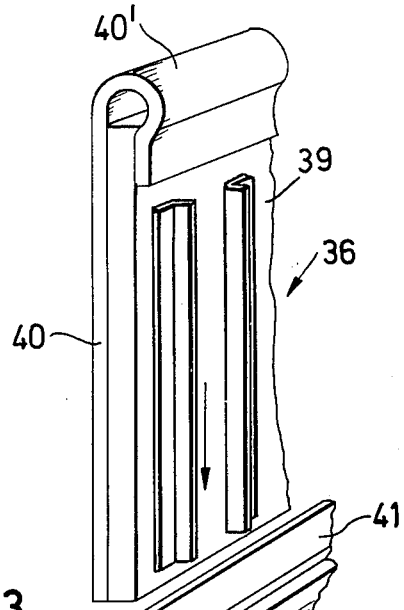
FIG. 3
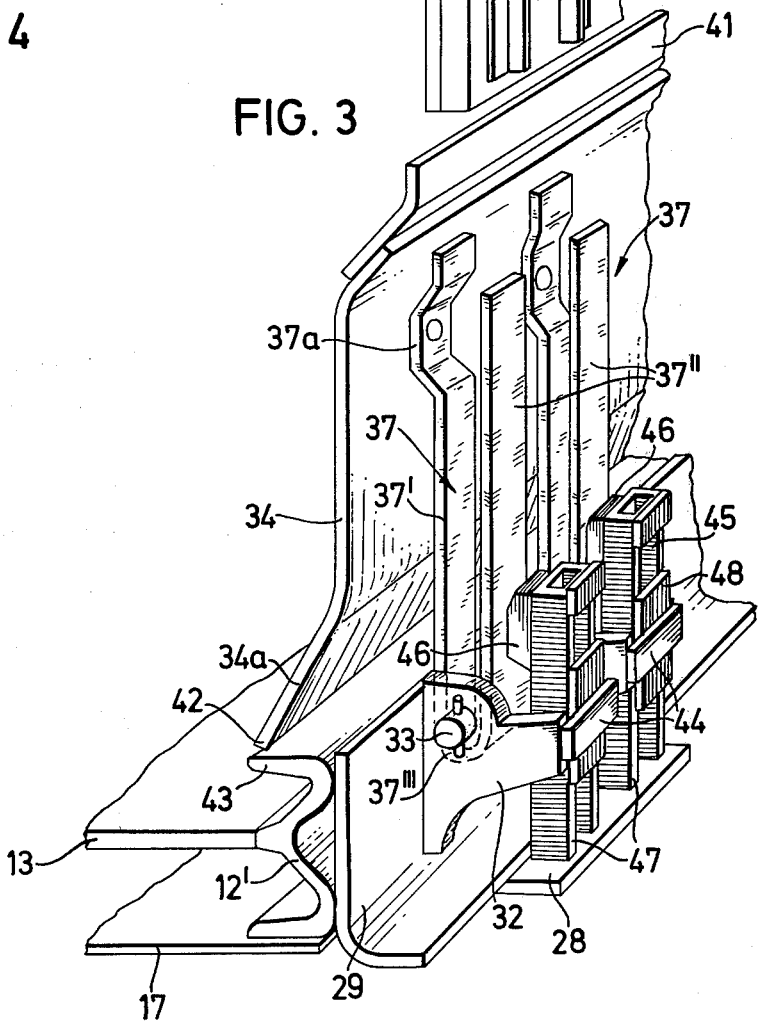

CONVEYORS FOR MINERAL MINING INSTALLATIONS

BACKGROUND TO THE INVENTION

The present invention relates in general to mineral mining installations and more particularly to conveyors for use in such installations.

It is well known in mineral mining, and especially in coal mining, to use a scraper-chain conveyor which is composed of a series of channels or pans arranged end-to-end and a scraper-chain assembly which is moved along the pans to transport material along the conveyor. Where valuable ores such as gold, are to be mined the ore-bearing material detached from the mineral face must be conveyed as far as possible without loss and this necessitates a modified form of conveyor. Various attachments such as barrier plates are known for increasing the capacity of the pans and for preventing some loss of material.

It is known that where the material is to be detached from the mineral face by explosive blasting, as is usual for gold mining or in the case of very hard coal deposits, some form of screen or shield can be used with the conveyor to generally retain the material in the working zone. The known attachments and equipment designed for the purposes mentioned are not particularly flexible in the operational sense. A general object of the present invention is to provide an improved form of conveyor for use in a mineral mining installation.

SUMMARY OF THE INVENTION

In its broadest aspect the invention provides a conveyor for use in transporting materials in a mineral mine working; the conveyor being provided with a screen capable of screening off the working zone and supported for pivoting to a collapsed position permitting access to the working zone.

In order to cope with explosive shock forces and the impingement of material where the material is detached by the explosive blasting method, it is desirable to have the screen resiliently mounted to the conveyor. The screen can be readily swung about the pivot axis to its collapsed position to permit access to the face, as for instance when the explosive charges are to be inserted into the face, or maintained upright to screen off the working zone. Preferably the screen, or more usually a part thereof, is raisable so that the screen can be raised into contact with the roof of the mine working when desired. The screen can thus comprise a resiliently mounted and pivotable lower wall and an upper wall which can be raised and lowered. It is advisable to sub-divide the screen into components or sections arranged end-to-end each section having one such upper wall and one such lower wall. Where the conveyor structure per se is composed of channel-like pans joined end-to-end it is advisable to have a plurality and more usually two, screen sections allocated to each pan. In order to provide the resilient mounting for the screen each screen wall section may have one or more U-shaped springs connected to the lower wall and pivotably supported on the conveyor pans. The upper walls can then locate between the arms of these springs so that the springs interconnect the walls and permit the adjustability of the upper walls while acting as a guide therefor. The springs may connect through pivot pins with a series of support brackets provided on the sides of the conveyor pans remote from the mineral face. The vertical adjustability of the upper walls of the screen ensures that the screen can reliably seal against the roof of the working when desired and preferably the upper ends of these upper walls have resilient cappings which actually contact the roof.

Similar resilient seals may be provided between the walls and between the lower walls and the conveyor pans.

In order to maintain the screen wall sections in an upright vertical position wedges or locking members can be provided. These members which are separate replaceable items can locate within the support brackets to engage in wedge-like manner wth the springs. When the locking members are removed the screen wall sections can pivot outwardly from the conveyor pans to their collapsed position.

Preferably the support brackets have stops which limit the outward pivoting of the screen wall sections. The support brackets are preferably carried by components or attachments secured to the goaf-side pans and engaging either directly or indirectly on the floor. One form of constructional embodiment utilizes L-shaped components with vertical portions secured to the pans and carrying the support brackets and horizontal portions welded to additional plates engaging on the floor.

Normally the screen, or more particularly the sections thereof, would be swung outwardly from the conveyor pans to the collapsed position. It is however possible to modify the design so that the screen, or at least some of the sections thereof, swing inwards towards the face. In this way a convenient working platform can be created.

In a preferred construction the invention provides a scraper-chain conveyor for use in a mine working; said conveyor comprising a series of pans joined end-to-end and a screen composed of individual sections arranged end-to-end at one side of the pans, each screen section being pivotably and resiliently supported on the associated pan so that the screen section can be swung laterally outwards to a collapsed position or brought into an upstanding position and each screen section having an upper wall which can be raised or lowered in relation to the associated pan and which can be raised into engagement with a roof of the mine working; whereby the screen sections can be collapsed to permit access to a mineral face zone or adjusted to screen off this zone.

The present invention may be understood more readily, and various other features of the invention may become apparent, from consideration of the following description.

BRIEF DESCRIPTION OF DRAWINGS

An embodiment of the invention will now be described by way of example only, with reference to the accompanying drawings, wherein:

FIG. 3 is a perspective view of part of the screen as seen from the goaf side with part of a displaceable upper wall component thereof shown separately;

FIG. 4 is a perspective view of part of the displaceable upper wall component showing its constructional features.

DESCRIPTION OF PREFERRED EMBODIMENT

Figure 1:
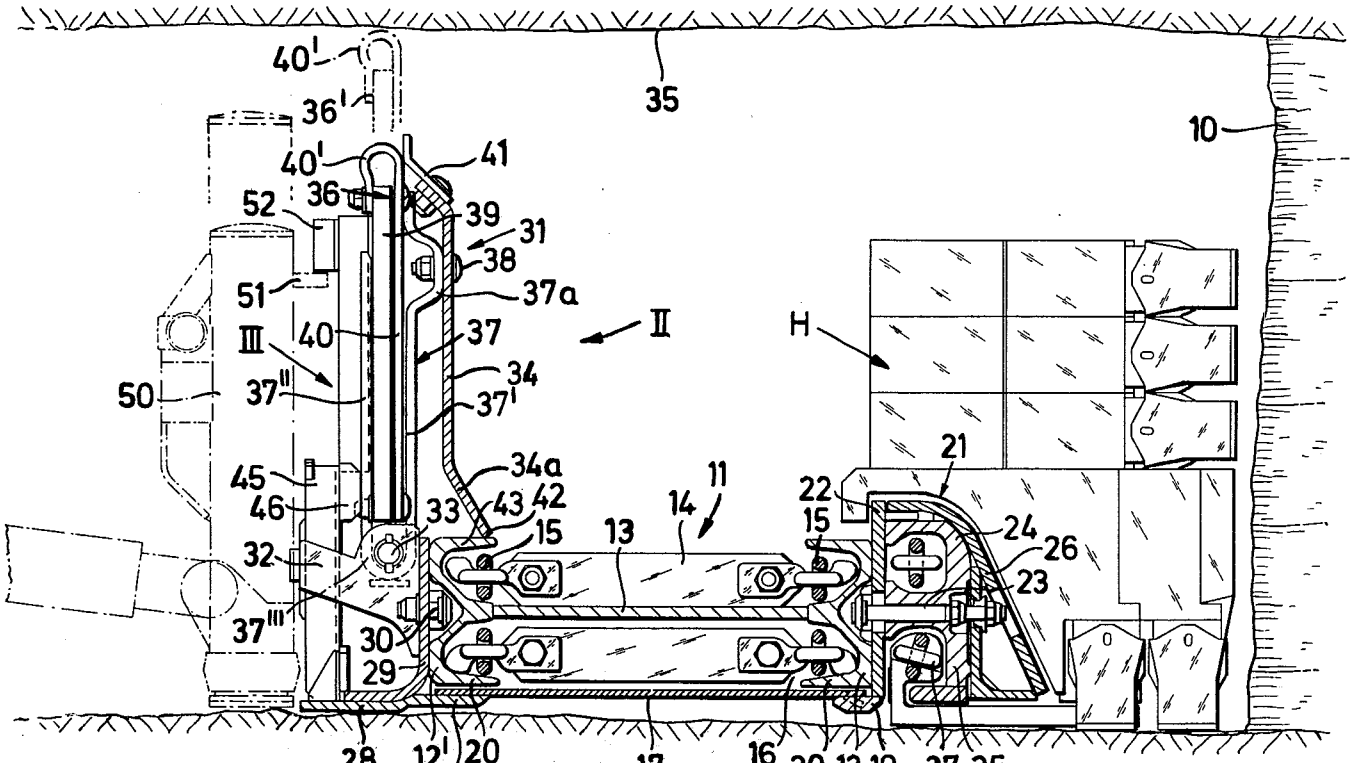
FIG. 1 is a part sectional schematic end view of a mineral mining installation employing a conveyor made in accordance with the invention.

As shown in FIG. 1, a mineral mining installation is disposed in a mine working having a roof 35, a floor and a mineral face 10. The face 10, which may be a short heading face or a longwall face, contains mineral in one or more seams or reefs. The installation serves in general to load and transport material detached from the face 10 and is especially suitable for use with valuable ores such as gold, where the stoping, loading and transport of materials should be carried out as far as possible without loss. The material can be detached from the face 10 by explosive blasting and the material thus detached can be transported by a scraper-chain conveyor denoted 11. A loading machine H is used to load some of the material falling between the conveyor 11 and the face 10 into the conveyor 11.

The conveyor 11 itself is composed in known manner of a series of pans or channel sections joined end-to-end. Where the face 10 is a short heading the length of the individual channel sections will be comparatively short but in the case of a longwall face the channel sections would be somewhat longer. Preferably the channel sections are interconnected so as to permit a certain amount of articulation between the channel sections. Each pan or channel section has side walls 12,12′ of sigma -shaped cross-section with a floor plate 13 connected, as by welding, between these walls 12,12′. The walls 12,12′ of the channel sections and their floor plates collectively define upper and lower guide passages within which a scraper-chain assembly is moved. The assembly is entrained around drive sprockets or drums and is driven to circulate within the guide passages. The assembly may be of the type illustrated having chains 15 with round or oval links interconnected by scrapers 14 spaced apart along the passages. Alternatively, the assembly may employ one or more central chains running along the central zone of the conveyor channel sections with the scrapers 14 spaced apart as before. The material entering the conveyor directly or loaded therein with the machine H is transported over the floor plates 13 with the aid of the srapers 14. The lower passage 16 wherein the lower return run of the scraper-chain assembly runs, is closed off from the floor by means of bottom plates 17. These plates 17 are supported by inwardly projecting strips 18, 19 of L-shaped components 22,28,29 fixed to the outermost sides of the channel section side walls 12,12′. The plates 17 are received in slots defined between the strips 18,19 and the lower flanges 20 of the channel section side walls 12,12′.

The upstanding portions of the L-shaped components 22 at the mineral face side walls 12 are detachably secured thereto with the aid of bolts 23 held captive within external V-shaped recesses in the walls 12. Wear-resistant inserts 24,25 and ramp-like guide plates 26 are secured to the upstanding portions of the L-shaped components 22 with the aid of these bolts 23. The plates 26 form a guide means 21 for supporting and guiding the loading machine H and the inserts 24,25 define upper and lower passageways which receive a drive chain 27 serving to move the machine H back and forth along the guide means 21. The lower run of the chain 27 in the lower passageway connects with the machine via one or more guide arms projecting beneath the guide means 21 and locating in the lower passageway in hook-like manner.

The L-shaped components 28,29 at the goaf side of the conveyor channel sections have portions 28 which form feet supporting the conveyor on the floor. The strips 18 and portions 28 can be formed from integral plates secured as by welding to the main L-shaped plates 29 having their upstanding portions detachably secured to the side walls 12′ with the aid of bolts 29 held captive within external V-shaped recesses in the walls 12′.

Figure 2:
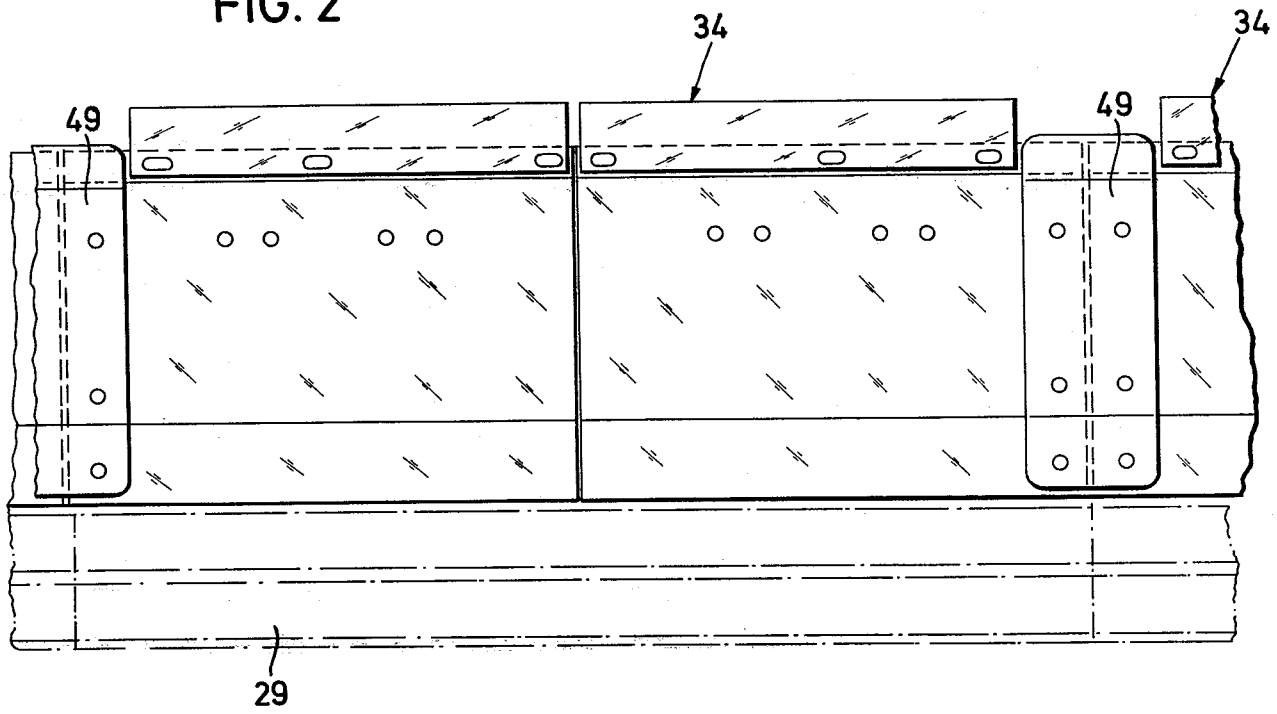
FIG. 2 is a front view of part of the screen of the conveyor as seen from the mineral face.
Figure 5:
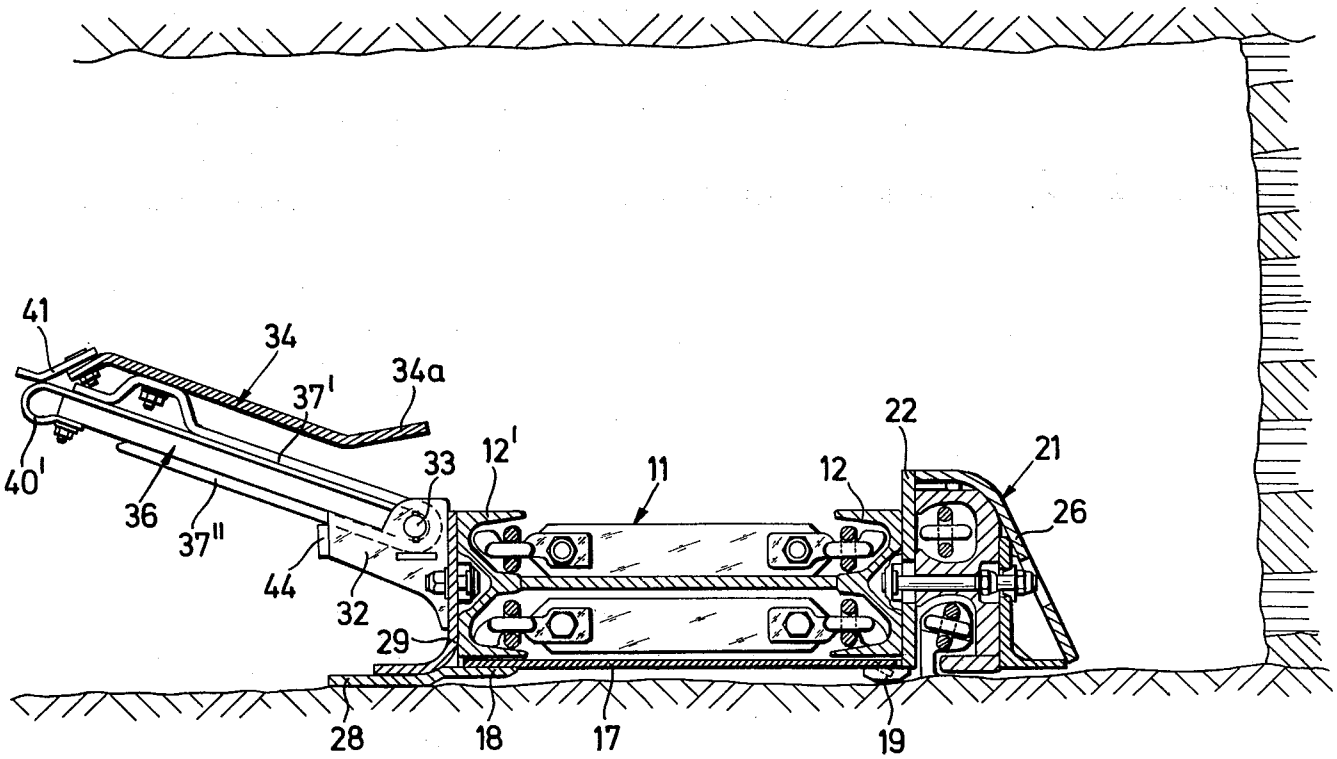
FIG. 5 is a part sectional view of the conveyor as shown in FIG. 1 but depicting the screen in its collapsed or non-operative state.

In accordance with the invention these plates 29 support a sealing screen 31 which will now be described in detail with reference to FIGS. 1 to 5. Each of the plates 29, which can be replaced by other attachments performing a similar function has an upstanding portion which preferably extends substantially over the entire length of one of the channel sections. These upstanding portions of the plates 29 carry U-shaped brackets 32 spaced apart along the conveyor. The outwardly projecting parallel arms of these brackets 32 support pivot pins 33 extending parallel to the conveyor and permitting the screen 31 to be collapsed, as shown in FIG. 5, or brought to an upstanding position as shown in FIG. 1. The screen 31 is itself composed of sections disposed end-to-end and preferably each conveyor pan or channel section has allocated to it two such screen wall sections so that each screen wall section extends over about one-half the length of the conveyor pan or channel section. FIG. 2 depicts two of the screen wall sections on one pan. Each screen wall section is composed of a lower wall 34 and an adjustably displaceable upper wall 36 which can be raised or lowered when the overall section is upstanding. The walls 36 are designed to be raised into contact with the roof 35 so that by raising all the walls 36 the stowage or goaf zone of the working can be entirely screened off and sealed from the working zone.

As shown, particularly in FIGS. 1 and 3, each screen wall section has two spring members 37 each of which is supported by one of the brackets 32. Each spring member 37 is a plate spring of elongate U-shaped formation with upstanding arms 37′,37″. The lower bight of juncture between the arms 37′,37″ of each of these spring members 37 extends around the pivot pin 33 referred to previously. Cross pieces in the brackets 32 may prevent the spring members 37 from moving downwards away from the pins 33. Each pivot pin 33 projects through aligned bores in the arms of the bracket 32 associated therewith and retaining pins 37‴ inserted through cross bores in the outer portions of the pin 33 retains it in position. The arm 37′ of each spring member 37 which faces the conveyor has a bent-out recessed upper portion 37*a* against which the associated lower wall 36 bears. This wall 36 is secured to the spring members 37 associated therewith with the aid of nuts and bolts 28 (FIG. 1). The other upper walls 36 are received between the arms 37′,37″ of the spring members 37. These arms 37′,37″ resiliently grip the walls 36 while permitting the latter to be raised or lowered while slidably guiding the walls 36 during such adjustment. For the sake of clarity part of the wall 36 of the screen section represented in FIG. 3 is shown separately from the rest of the screen wall section.

In order to raise or lower the walls 36 use can be made of one or more hydraulic devices such as props or rams one of which is represented by chain-dotted lines 50 in FIG. 1. This device 50 has a projection 51 on its extendible upper part which can engage on stops 52 on the walls 36. The device or devices 50 may effect both raising or lowering of the walls 36 although the walls 36 can lower themselves under gravity and require a plurality of devices 50 to maintain their raised positions.

As shown in FIG. 4, the upper walls 36 of the screen are each formed from one or more grid-like plates 39 covered over on the front side facing the conveyor with a sheet 40 made from rubber or a similar synthetic plastics material. The sheet 40 is formed around the upper end of the plate(s) 39 to produce a resilient capping 40' and the reverse lip of the sheet 40 is secured at the rear side thereof, such as by screws or bolts shown in FIG. 1. This top capping 40' produces a resilient seal engageable with the roof 35.

To effect sealing between the upper and lower walls 36,34 of each screen section the lower walls 34 are bent outwards towards the walls 36 along their upper edges and sealing strips 41 of rubber or the like are secured to these bent upper edge margins as shown in FIG. 3. The strips 41 can be detachably secured to the walls 36, for replacement purposes, by the use of screws or bolts for example as shown in FIG. 1, and engage on the walls 36 in sealing relationship. The walls 34 are also bent at their lower edges as shown in FIGS. 1 and 3, but in the opposite sense to the upper edges, to produce inclined lower edge margins 34*a*, which can engage in sealing relationship with their lower edges on the upper flange 43 of the conveyor channel section side walls 12' when the screen sections are upstanding.

The screen sections are retained in their upstanding position by selectively operable clamping means in the form of detachable locking members 45 shown in FIGS. 1 and 3. With these members 45 removed, the screen sections composed of the walls 36,34 interconnected through the spring members 37, can pivot laterally outwards from the conveyor channel sections about the pivot pins 33. The arms of each of the support brackets 32 are interconnected at their ends by webs 44 and, as shown in FIG. 5, these webs 44 form stops which engage on the outer arms 37'' of the spring members 37 to limit the pivotal movement of the screen sections. By pivoting the screen sections in this manner individually or in groups or in toto the section or sections in question will be supported by the webs 44 in what is effectively an inoperative collapsed state permitting access to the working zone. To retain the screen sections in their upstanding operative working position the members 45 are inserted between the webs 44 and the arms 37'' of the spring members 37 with the screen wall sections upright, as shown in FIGS. 1 and 3.

As shown more particularly in FIG. 3, each member 45 is received in a compartment defined with one of the support brackets 32 and has its lower end 47 resting on one of the foot portions 28 of the plates referred to previously. In this way the members 45 effectively stand on the floor of the working. Each member 45, which may be a prefabricated structure as shown in FIG. 3, constructed from strips or plates, has a block 46 at its inner side which engages on the arm 37'' of the associated spring member 37 in the manner of an abutment. To increase the pressure on the spring members 37 a separate plate 48 can be inserted between each of the webs 44 and the body of the member 45. Where the members 45 are prefabricated structures as shown the plates 48 can be used as reinforcements for the body of the members 45 and further plates or wedges can be inserted between these plates 48 and the webs 44.

As mentioned previously, each channel section or pan side wall 12' has allocated to it two screen sections constructed as described. Thus each channel section bears two lower walls 34 and two upper walls 36 to each screen section composed of one wall 34 and one wall 36, two spring members 37 supported on associated brackets 32 can be provided as represented in FIGS. 2 and 3, or alternatively four such spring members 37 and four brackets 32 can be provided for each wall 34,36. The walls 34 may engage one another at their ends along the conveyor. Alternatively as shown in FIG. 2, the walls 34 on each channel section may engage on one another and additional covers 49, which are preferably resiliently flexible, can be secured to seal off the gaps between the walls 34 of adjacent channel sections.

During use of the installation as described where the material is detached from the face 10 by explosive blasting the screen 31 can be collapsed in the manner described (FIG. 5) to permit access to the face 10. Holes can now be drilled in the face 10 and charged with explosive. The screen 31 is then brought into its upstanding position and secured with the members 45. The walls 36 are then raised with the aid of the device or devices 50 to adopt the position represented in chain-dotted lines designated 36' in FIG. 1 where they engage on the roof 35 with their resilient cappings 40'. In this way the screen 31 shields off the entire working zone. The explosive charges are now detonated and the resilience of the screen 31 absorbs the shock waves and ensures the detached material cannot escape from the working zone. The screen 31 is capable of withstanding impact from material ejected from the face by the explosives. Material detached from the face 10 in this manner falls directly into the conveyor and also between the conveyor and the working face 10. This latter proportion of the detached material is loaded into the conveyor by the machine H and the conveyor transports the material for further treatment.

I claim:

1. The combination of a conveyor for conveying material in a mineral mine working, a screen capable of screening off the working zone and means for pivoting the screen to the conveyor to permit the screen to pivot to a collapsed position when desired to allow access to the working zone, wherein the screen is composed of a series of sections arranged end-to-end, each section being independently pivotable, and wherein each section is composed of a lower wall resiliently mounted to the conveyor and pivotable in relation thereto and an upper wall which is raisable and lowerable in relation to the lower wall.

2. The combination of claim 1, wherein the lower wall of each section is connected to at least one spring member which is pivotably mounted to the conveyor.

3. The combination of claim 2, wherein each spring member is of U-shaped formation with one arm secured to the lower wall of the associated screen and the juncture between the arms extending around a pivot pin rendering the entire section pivotable.

4. The combination of claim 3, wherein the upper wall of each section is received for sliding between the arms of the, or each, associated spring member.

5. The combination of claim 4, wherein the pivot pins for the spring member are carried by supports fixed to one side of the conveyor.

6. The combination of claim 5, wherein detachable locking members serve to retain the screen wall sections in an upright position and are removed when the sections are to be pivoted to the collapsed position, and wherein the locking members are insertable into the supports to engage on the other outermost arms of the spring members.

7. The combination of claim 5, wherein the conveyor is composed of a plurality of channel section pans each with side walls and a floor arranged end-to-end and a scraper-chain assembly movable over the floors of the channel section pans to effect the transport of material, wherein each channel section pan has at least two screen sections on one of its side walls, wherein the supports are in the form of U-shaped brackets attached to L-shaped plate components secured to the outside of the channel section pan side walls and wherein each L-shaped component is engageable through at least one attached plate with the floor and the attached plates have a strip like inner projection supporting a bottom plate for closing off the lower run of the scraper-chain assembly.

8. The combination of claim 1, wherein detachable locking members are used to retain the screen in an upstanding position and are removable when the screen is to be pivoted to its collapsed position.

9. The combination of claim 1, wherein the lower wall of each section has sealing means for engaging on the upper wall and for effecting sealing therebetween.

10. The combination of claim 1, wherein each upper wall has a resilient capping at its uppermost edge engageable with the roof of the mine working when the wall is fully raised.

11. The combination of claim 1, wherein the conveyor is composed of a plurality of channel section pans each with side walls and a floor arranged end-to-end and a scraper-chain assembly movable over the floors of the channel section pans to effect the transport of material and wherein each channel section pan has at least two screen sections on one of its side walls.

12. The combination of claim 11, wherein there are a plurality of channel sections each with side walls and a floor arranged end-to-end and a scraper-chain assembly movable over the floors to the channel sections to effect the transport of material and wherein each channel section bears a component section of the screen on one of its side walls.

13. A scraper-chain conveyor for use in a mine working; said conveyor comprising a series of pans joined end-to-end and a screen composed of individual sections arranged end-to-end at one side of the pans, each screen section being pivotably and resiliently supported on the associated pan so that the screen section can be swung laterally outwards to a collapsed position or brought into an upstanding position, and each screen section having an upper wall which can be raised or lowered in relation to the associated pan and which can be raised into engagement with a roof of the mine working, whereby the screen sections can be collapsed to permit access to a mineral face zone or adjusted to screen off this zone.

14. A conveyor according to claim 13 and further comprising spring members of elongate U-shaped configuration pivotably supported to the pans and each attached through one arm to one of the lower walls with the upper walls being slidably received between the arms of these spring members.

* * * * *